US006400268B1

(12) United States Patent
Lindskog

(10) Patent No.: US 6,400,268 B1
(45) **Date of Patent: *Jun. 4, 2002**

(54) ELECTRICAL MANUALLY PORTABLE SECURITY CASE FOR THE STORAGE OF THEFT ATTRACTIVE ARTICLES WITH AN ELECTRICAL MAT HAVING AT LEAST ONE ELONGATED ELECTRICALLY CONDUCTIVE WIRE IN A SUBSTANTIALLY CONTINUOUS MESH, LOOP OR EYE STRUCTURE

(76) Inventor: Kjell Lindskog, Nygatan 49, S-931 31 Skellefteå (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/612,990

(22) Filed: Jul. 10, 2000

Related U.S. Application Data

(63) Continuation of application No. 09/118,355, filed on Jul. 17, 1998, now Pat. No. 6,215,397, which is a continuation of application No. 08/696,136, filed on Aug. 13, 1996, now abandoned, which is a continuation of application No. 08/336,579, filed on Nov. 9, 1994, now abandoned, which is a continuation-in-part of application No. PCT/SE93/00412, filed on May 10, 1993.

(30) Foreign Application Priority Data

May 11, 1992 (SE) ..... 9201483

(51) Int. Cl.[7] ..... G08B 13/00

(52) U.S. Cl. ..... 340/550; 340/551; 340/552; 340/561

(58) Field of Search ..... 340/550, 540, 340/564, 565, 566, 567, 551; 307/147; 109/24, 42

(56) References Cited

U.S. PATENT DOCUMENTS

| | | | | |
|---|---|---|---|---|
| 181,078 | A | 8/1876 | Larned | 340/550 |
| 206,182 | A | 7/1878 | Koloseus | 109/39 |
| 362,010 | A | 4/1887 | Jewill | 174/122 R |
| 708,093 | A | 9/1902 | Sutton et al. | 109/42 |
| 880,020 | A | 2/1908 | Grass | 109/42 |
| 1,097,587 | A | 5/1914 | Hammond | 340/508 |
| 1,920,742 | A | 8/1933 | Chapman et al. | 109/82 |
| 3,594,770 | A | 7/1971 | Ham et al. | 340/550 |

(List continued on next page.)

FOREIGN PATENT DOCUMENTS

| | | |
|---|---|---|
| CH | 280337 | 4/1952 |
| DE | 2745178 | 4/1978 |
| DE | 2747285 | 4/1979 |
| DE | 3028399 | 2/1982 |
| DE | 3234583 | 5/1983 |
| DK | 0149274 | 4/1986 |
| DK | 0159586 | 11/1990 |
| EP | 0039371 | 11/1981 |
| FR | 2497981 | 7/1982 |
| GB | 1375926 | 12/1974 |
| GB | 2199890 | 7/1988 |
| SE | 0409481 | 8/1979 |
| WO | 9322751 | 11/1993 |

*Primary Examiner*—Van Trieu
(74) *Attorney, Agent, or Firm*—Nils H. Ljungman & Associates

(57) ABSTRACT

A security structure intended particularly for the construction of security containers and security rooms. The security structure has an alarm mat integral therewith. The alarm mat is constructed from one or more insulated, electrically conductive threads, wires or the like, or from one or more light conducting, optical fibres. The thread or threads is/are disposed to form continuous meshes, lopps, or eyes of the kind obtained when knitting or crocheting.

23 Claims, 5 Drawing Sheets

U.S. PATENT DOCUMENTS

| | | | | |
|---|---|---|---|---|
| 3,696,373 | A | 10/1972 | Dunn et al. | 340/550 |
| 3,763,795 | A | 10/1973 | Wetz, Jr. | 109/24 |
| 4,389,948 | A | 6/1983 | Sands et al. | 109/82 |
| 4,523,528 | A | 6/1985 | Hastings et al. | 109/42 |
| 4,558,308 | A | 12/1985 | Ciordinik et al. | 340/550 |
| 4,681,591 | A | 7/1987 | Okayasu et al. | 8/115.68 |
| 4,799,435 | A | 1/1989 | Boutroy | 109/25 |
| 4,852,502 | A | 8/1989 | Klingberg et al. | 109/25 |
| 5,152,508 | A | 10/1992 | Fish | 256/24 |
| 5,285,734 | A | 2/1994 | MacPherson | 109/42 |
| 5,539,379 | A | 7/1996 | MacPherson | 340/550 |
| 5,592,149 | A | 1/1997 | Alizi | 340/550 |
| 5,677,674 | A | 10/1997 | Wolf | 340/541 |
| 5,796,335 | A | 8/1998 | Droege et al. | 340/550 |
| 6,215,397 | B1 * | 4/2001 | Lindskog | 340/550 |

* cited by examiner

ELECTRICAL MANUALLY PORTABLE SECURITY CASE FOR THE STORAGE OF THEFT ATTRACTIVE ARTICLES WITH AN ELECTRICAL MAT HAVING AT LEAST ONE ELONGATED ELECTRICALLY CONDUCTIVE WIRE IN A SUBSTANTIALLY CONTINUOUS MESH, LOOP OR EYE STRUCTURE

This is a continuation of U.S. Ser. No. 09/118,355, filed on Jul. 17, 1998, now U.S. Pat. No. 6,215,397, which claims continuing status from U.S. Ser. No. 08/696,136, filed on Aug. 13, 1996, which is abandoned and a file-wrapper continuation of U.S. Ser. No. 08/336,579, filed on Nov. 9, 1994, which is abandoned and claims continuation-in-part status from International Patent Application No. PCT/SE93/00412, filed on May 10, 1993, which claims priority from Swedish Patent Application No. 9201483-6, filed on May 11, 1992. International Application No. PCT/SE93/00412 was pending as of the filing date of application Ser. No. 08/336,579. The United States was an elected state in International Application No. PCT/SE93/00412.

BACKGROUND OF THE INVENTION

1. Field of the Invention

The present invention relates to an electrically protected manually transportable container, such as a briefcase, with electrical alarm system structures, for the storage of theft-attractive articles and the like.

2. Background Information

Because of the increase in criminal activities among other things, there is a great demand for more positive forms of transportation and storage of valuable articles and theft-attractive objects of different kinds.

The transportation of money between different geographical locations is one example of areas in which greater security is desired. In cases of this nature, it is necessary to undertake large and expensive security measures, in order to protect the valuables from theft and robbery to an acceptable extent. The cost in achieving this is considerable, and the design of the necessary transport vehicles is both problematic and complicated.

One method of meeting the aforesaid problems is to equip the transport container concerned, which may have the form of a case, with one or more destructive elements which are activated to destroy the contents of the container, should an unauthorized person attempt to open the container and remove its contents. The fact that the contents of the container will be destroyed and rendered unusable if an unauthorized attempt is made to force the container, will act as a theft deterrent until some creative person devises a method of preventing activation of the destructive elements.

A case in which banknotes are transported is one concrete example of a transport container in the context intended here. The banknotes can be rendered useless as legal tender, by equipping the case with dye cartridges which are activated so as to stain the banknotes should an unauthorized attempt be made to open the case.

It will be understood from this that there is a need for a not-easily forced container, which in the case of a portable container shall be as light as possible.

The container will, of course, be equipped with a reliable alarm system or security system, of which at least certain parts are located within the container, The system is constructed so that the destructive element or elements will always be activated before the security system for the destructive element can be rendered safe by unauthorized methods and before the valuables stored in the container can be removed therefrom unlawfully. For instance, the security system must have a short reaction time, so as to prevent the system being disarmed by means of a so-called high speed weapon, for instance.

Such security systems and destructive elements are already known and commercially available, and it is therefore unnecessary to describe such systems and destructive elements in more detail here. It should be mentioned, however, that the security system can, of course, be designed to afford the burglar only a very short, limited length of time in which to attempt to force the container before the destructive element is activated, despite the fact that the security system has not been triggered by the attempt to force the container.

The present invention relates to alarm system structures. The invention also relates to the use of the structure in the construction of a container casing or in the construction of a room or space intended for the storage of theft-attractive articles and the like.

OBJECT OF THE INVENTION

The main object of the present invention is to provide a particularly designed laminate structure which can be used to great advantage in the construction of a wall or a casing of a security container or of a security room or space. This object is achieved with a laminate structure defined in the following claims and also with the use of such a laminate.

SUMMARY OF THE INVENTION

Among the many advantages afforded by the invention is that it can be made thin and light in weight, which, of course, imparts weight advantages to the transport container in which the laminate is used, for instance.

The inventive laminate is constructed in a manner which enables the laminate to handle effectively such external disturbances as magnetic fields, static electricity and the like.

The laminate can be given a rigidity or stiffness which enables a self-carrying container to be constructed therefrom.

The laminate can be manufactured in desired shapes and curves, therewith enabling containers of complicated shapes to be produced with the aid of the inventive laminate.

When desiring to complement an existing construction with a protective shell, this can be readily achieved with the aid of the inventive laminate. For instance, separate, angled corner laminates can be prefabricated.

BRIEF DESCRIPTION OF THE DRAWINGS

The invention will be described in more detail with reference to exemplifying embodiments thereof and also with reference to the accompanying drawings in which.

DESCRIPTION OF THE PREFERRED EMBODIMENT

Figure 1:
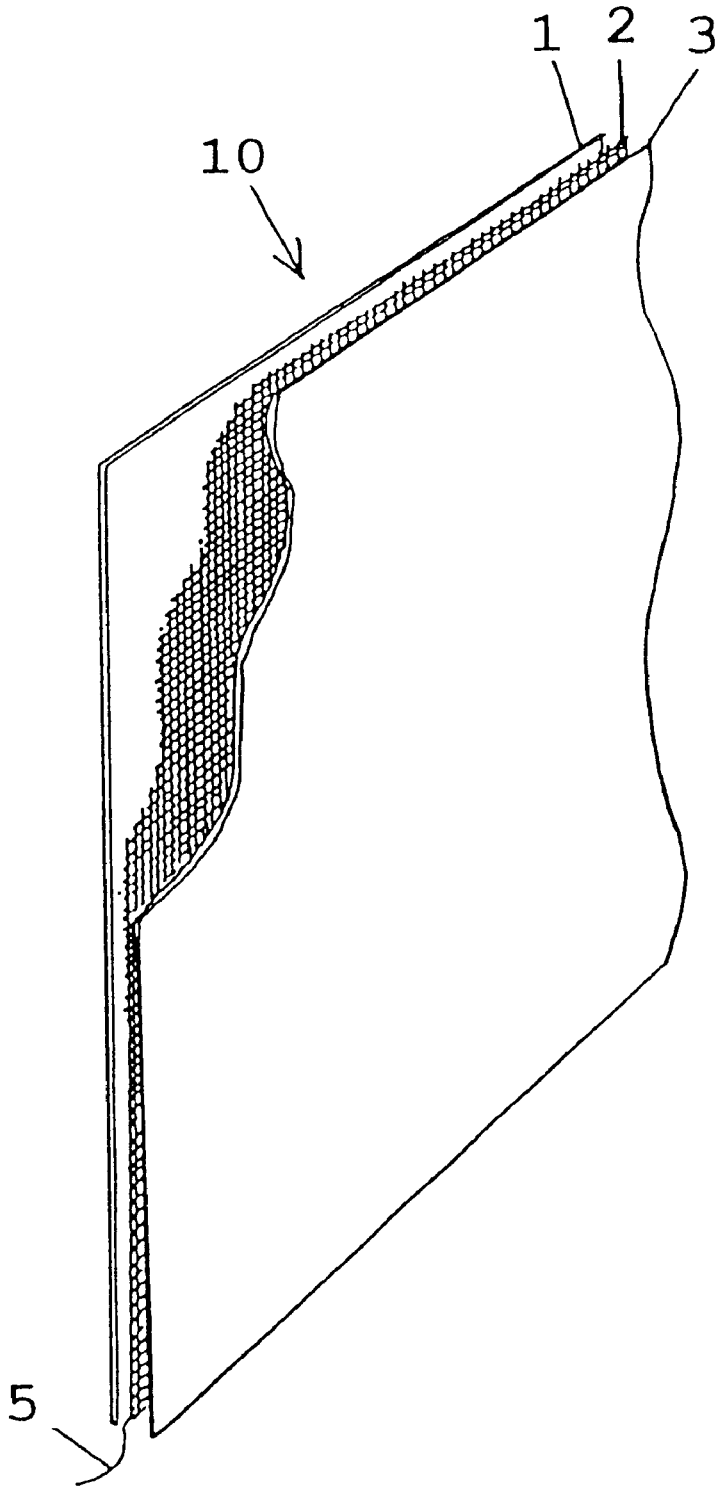
FIG. 1 is an exploded perspective view which illustrates the construction of an inventive laminate.
Figure 2:
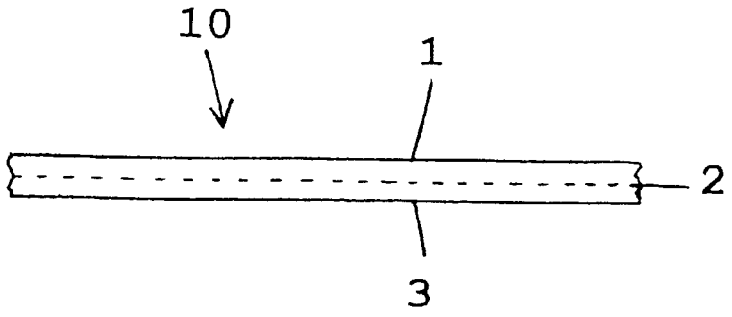
FIG. 2 is a cross-sectional view of the laminate.

FIGS. 1 and 2 illustrate a laminate 10 including a first outer sheet or layer 1, an alarm mat 2 and a second outer sheet or layer 3.

The first outer sheet 1 is comprised, for instance, of a fiberglass mat or a textile mat, although other types of mats, cloths or sheets can be used. The outer sheet 1 may also consist of paint or a gel coating.

The alarm mat 2 is intended to indicate or to detect an attempt to make a hole in the laminate 10. The alarm layer/alarm mat 2 is comprised of a fine-mesh net structure, for instance a knitted, crocheted or woven structure. The material used is an electrically conductive material, and may have the form of wires, filaments or strips of metal or an electrically conductive plastic material, hereinafter referred to genetically as threads. The "threads" 3 of material used are coated with an insulating layer. For instance, the threads may consist of copper threads coated with an insulating varnish of the type normally used in small electric motors, A net structure consisting of varnished copper wires having a diameter of 0.3 mm and a mesh density or mesh size of about 1 mm is a non-limiting example of one conceivable not structure. Optical fibres may also be used.

Figure 3:
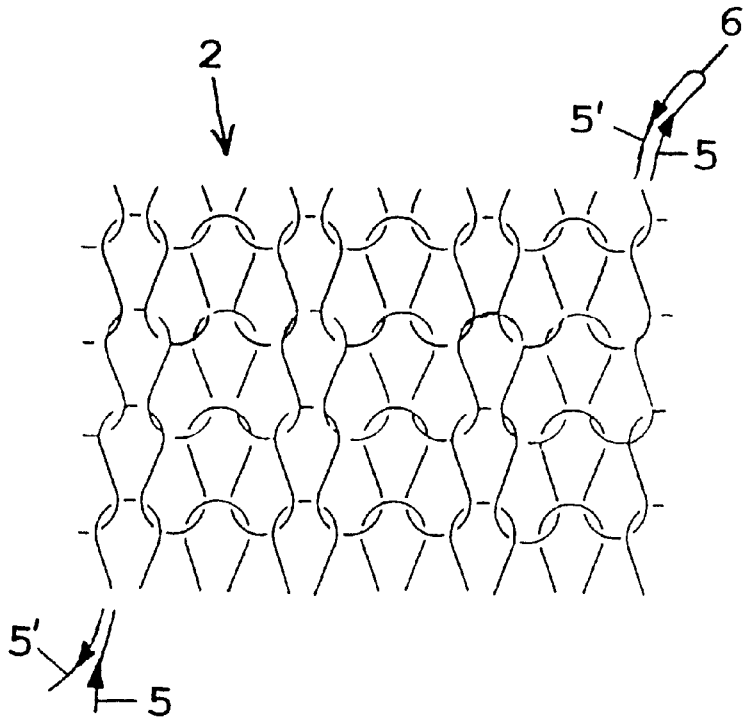
FIG. 3 illustrates schematically one method of constructing an alarm mat.

FIG. 3 illustrates very schematically one method of constructing an alarm mat 2 in accordance with the invention. The alarm mat 2 shown partially in FIG. 3 is a knitted structure. When the structure is knitted with a single thread 5 solely two thread ends are obtained with the mat, such as to obtain a continuous electric circuit. The mat 2 may alternatively be constructed from double threads 5, 5', which results in two continuous electric circuits. According to one highly advantageous embodiment of the invention, the aforesaid electric circuits are connected together so that the mat 2 will obtain a single electric circuit in which current flows in different directions in the mutually parallel threads 5, 5'. This connection 6 of the parallel threads 5, 5' is illustrated schematically in FIG. 3 and the arrows show the contraflow of electric current through said threads 5, 5' through the meshes, loops or eyes of the mat 2.

The alarm layer/alarm mat 2 is thus comprised of a fine-mesh material, and a central inventive feature of the mat is that it is constructed from one or more insulated, electrically conductive threads, and that the thread or threads is/are disposed to form mutually integral meshes, loops or eyes, for instance of the kind obtained when knitting, crocheting or weaving thread material. This also applies to the use of optical fibres.

The inventive alarm mat is extremely capable of resisting disturbances in the form of electromagnetic force fields, static electricity and the like.

Prevailing technical requirements on the alarm layer 2, such as mesh density, the number of electric circuits provided, the flexibility of the mat, and so on, are factors which control the choice of an appropriate method of manufacture. One or more electric signals are transmitted through the mat 2 and any attempt to make a hole in the laminate 10 will result in the fracture of a thread, or a number of threads in the mat, causing the electric signal to be interrupted and an alarm to be triggered. The same applies to the use of optical fibres with regard to light signals passing through the mat.

The second outer layer or sheet 3 is conveniently constructed in the same manner or in a similar manner to the first outer layer or sheet 1.

In the majority of cases, the laminate 10 is used so that the outer sheet 1 will form the exterior of the container and the second sheet or layer 3 will form the interior of said container, and the finish and construction of respective outer layers or sheets may be varied accordingly.

When manufacturing the laminate 10, the sheets –are joined together in some appropriate manner, for instance by gluing, injection-moulding or press-moulding techniques. A number of different adhesive binders can be used in this regard, for instance polyester resin or other resins may be used, therewith to produce a stable laminate. When manufacturing the laminate, it is possible, of course, to impart a number of different shapes to the laminate, in addition to a flat shape. For instance, a security container or a security case can be produced from solely two curved laminate sections which overlap one another at their meeting point. An example of a transport container or case 20 constructed in this way is illustrated in FIG. 4.

Figure 4:
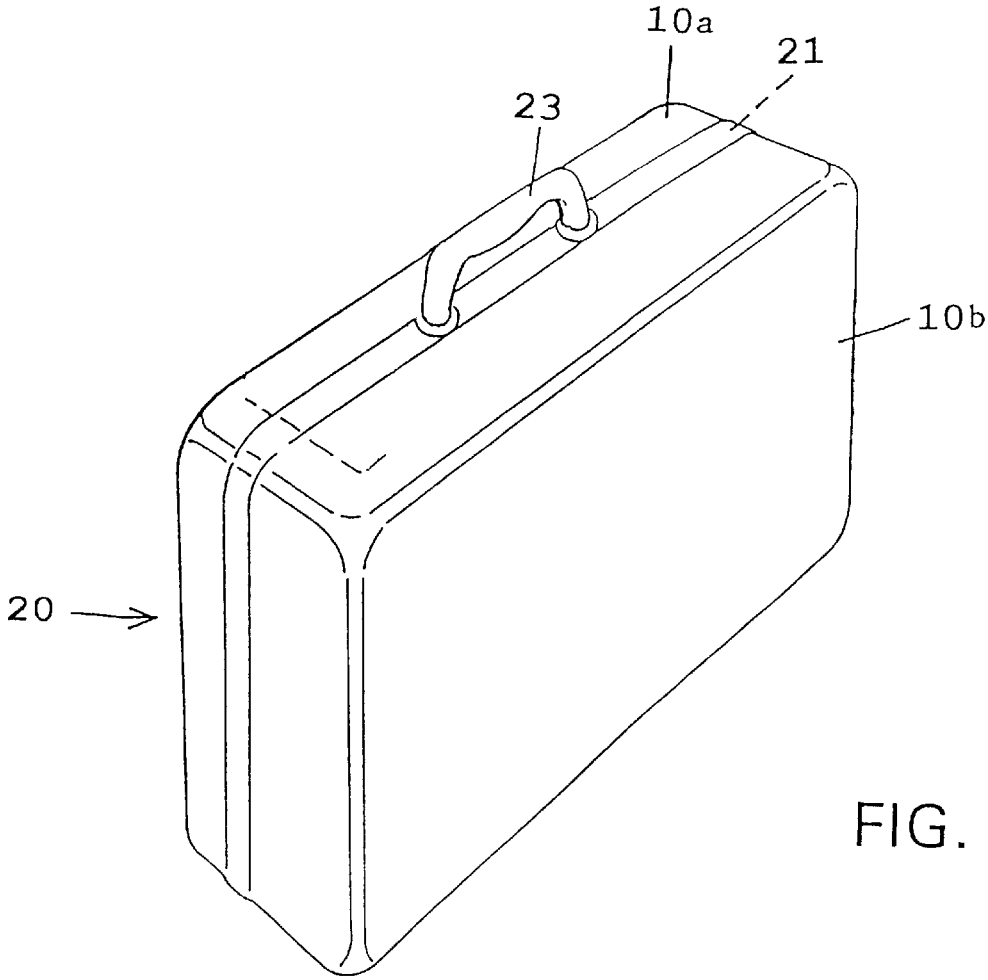
FIG. 4 is a perspective view of a transport container/security container constructed from inventive laminates.

The case 20 illustrated in FIG. 4 is constructed from two particularly shaped inventive laminate sections 10*a* and 10*b*, said sections being so configured that when the case is closed, the laminate sections will overlap in an overlap zone 21 which presents the smallest possible gap or clearance 22 between the overlapping parts. The case 20 is typically provided with a handle 23 glued to the outside of the case, and also with hinge means, locking devices, etc., which are mounted in a manner which excludes the necessity of perforating the laminate sections. A number of electrical contact or detector 24 and 25 are mounted immediately inwards of the overlapping zone 21, the devices 24 being carried by a strip 26 bonded to the laminate section 10*a* and the devices 25 being carried by a further strip 27 glued to the other laminate section 10*b*. The stripe 26 and 27 will preferably extend around the full perimeter of the container 20, and an appropriate number of electric contact devices 24, 25 are therewith mounted around the container perimeter. A security cage is formed by mutually connecting the respective alarm mats 2 of the laminate sections 10*a* and 10*b* and the electrical contact devices 24 and 25, so as to form one or more electric signal circuits. The circuit or circuits is/are broken when a thread 5, 5' in the mat 2 is fracture or cut as a result of attempting to make a hole in the container, and it will be understood from this that the mat 2 will extend over the whole of the container surface. A mat overlap is also provided in the overlap zone 21. The signal circuit will also be broken when attempting to widen the gap 22, by bending apart the overlapping parts of respective laminate sections in an attempt to unlawfully force the container 20. When attempting to widen the gap, the space between the devices 24 and 25 will alter and therewith break the electric circuit.

Mounted inside the container 20 is an electronic unit and one or more ampules or cartridges which contain a destructive agent, for instance dye cartridges. The electronic unit is constructed so as to activate the cartridges or ampules immediately the circuit is broken, so as to destroy or render useless the valuables stored in the container 20. Activation and deactivation of the alarm system/electronic unit is effected with the aid of an appropriate high security code system. Naturally, the container or case 20 will also contain a current supply source. It is conceivable in this regard to preset a time at which the destructive element is activated or triggered, with the intention of introducing an additional stress factor for those attempting unlawful access to the container.

With regard to the inventive security container 20, it has been established in practice that the inventive alarm mat 2 consisting of mutually integral meshes, loops or eyes, will function as a particularly effective guard against external disturbances, for instance in the form of magnetic fields of different kinds and electrostatic fields and the like, in addition to its aforedescribed hole-security function. This second function is achieved because the tensions induced or the disturbances generated by such external disturbances are dampened by the laminate so quickly as to enable the reaction time of the electronic unit to be made so short as to render it impossible to disarm the destructive element in time, even when firing, for instance, a high speed weapon towards the activating device of the destructive element. Due to the very rapid damping of disturbance signals, the risk of the disturbance element being triggered as a result of a false alarm caused by said external disturbances is greatly reduced. A thread (wire, filament, band, etc.) and an electric circuit is, in many instances, a sufficient protection against external disturbances in the form, e.g., of powerful magnetic fields and transient voltages. However, the arrangement of two mutually parallel threads which are connected in an electric circuit with in which current flows in opposite directions affords a still better resistance to external disturbances. The inventive alarm mat 2 will thus effectively prevent disturbance of the electronic and data equipment carried within the container constructed from the inventive laminate sections 10.

It will be understood that a refined security system based on the use of the inventive laminate structure can be constructed in many different ways.

It will be evident that the aforedescribed container or case 20 can thus be used effectively for the safe transport of valuable commodities.

Figure 6:
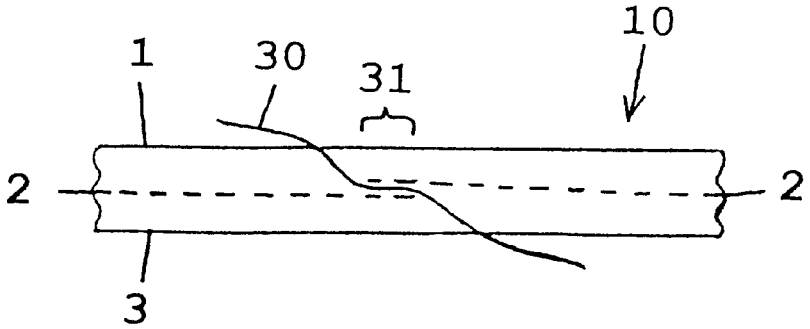
FIG. 6 is a cross-sectional view of an advantageous cable throughlet in an inventive laminate.
Figure 5:
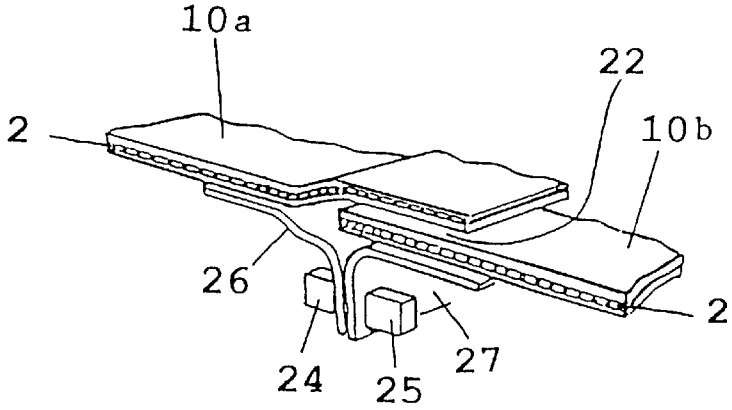
FIG. 5 is a cross-sectional view of one embodiment of an openable, overlapping join between the laminates of the container shown in FIG. 4.

FIG. 6 illustrates an example of a throughlet for a signal-carrying cable arranged in one laminate section 10. In the illustrated case, an overlap zone 31 is conveniently provided in the mat 2, so as to eliminate the possibility of a hole being made through the laminate section 10 without resulting in an alarm. In the case of a knitted mat 2, it is possible to provide an overlap zone of sufficient dimensions for the purpose intended, by knitting a so-called button-hole in the alarm mat. The cable throughlet shown in FIG. 6 may be used in conjunction with the illustrated security case 20, for instance.

Figure 7:
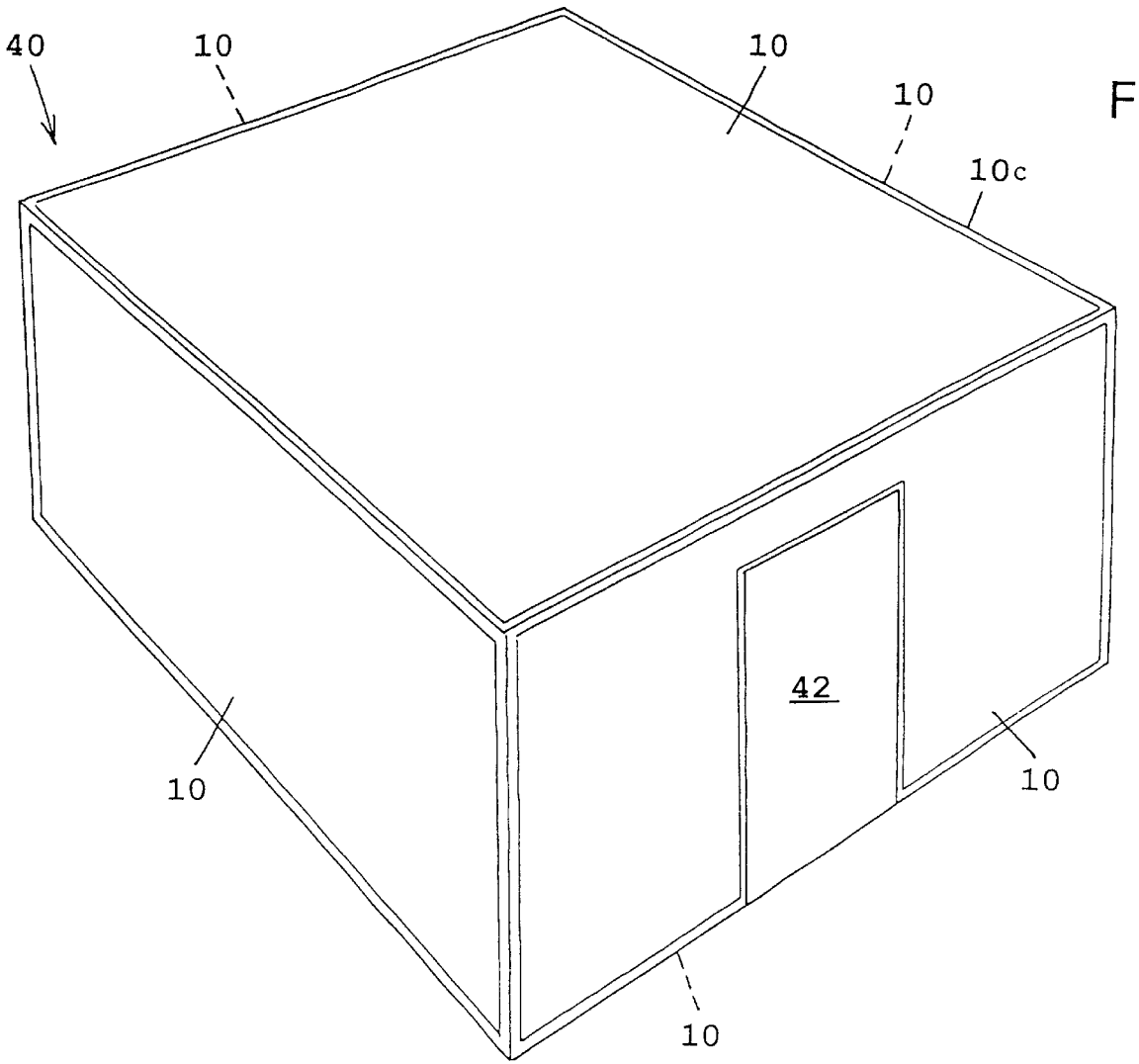
FIG. 7 is a schematic, perspective view illustrating an example of a space defining structure constructed from inventive laminates.
Figure 8:
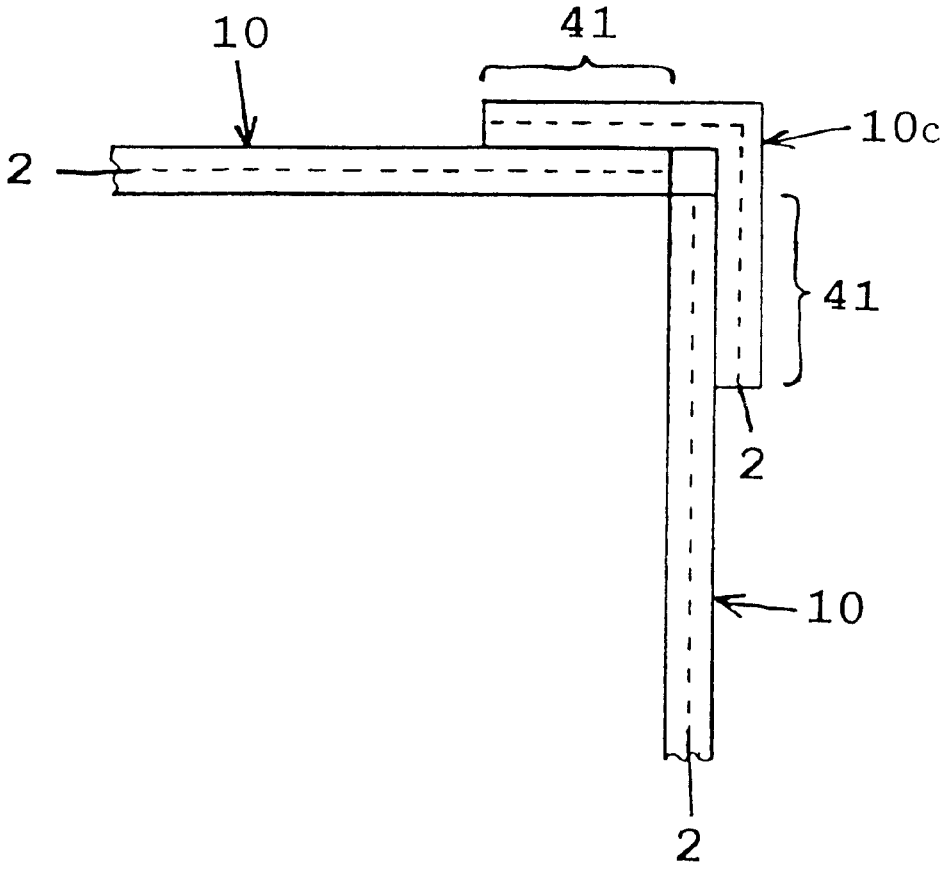
FIG. 8 is a schematic cross-sectional view of one corner part of the structure illustrated in FIG. 7.

FIG. 7 illustrates an example of a security space or room 40 built from inventive laminate sections 10. When constructing the room 40, it will preferably be ensured that the joint regions of the laminate sections include overlap zones 41 (see FIG. 8), so that the mat 2 will be continuous, as described above with reference to the case 20. Although not shown, each overlapping joint is suitably provided with bend-indicating contact devices, similar to the embodiment aforedescribed with reference to the case 20. Some overlapping joins may also be adhesively bonded. Overlapping of adjacent laminate sections at the corners of the room structure 40 can be facilitated with the aid of separate, angled laminate strips 10*c*.

The laminate strips 10*c* or the angled corner strips may, of course, be placed internally of respective laminate sections 10. The room structure 40 is provided with a door 42, or some similar entrance, and means for indicating overlapping and bending of the laminate section devices will also be provided around the door or like entrance.

The inventive laminate 10 can thus be used in the construction of containers, rooms or other spaces where it is desired to prevent access by making holes in the structure, for instance. If a hole is made in a structure comprised of the inventive laminate, a destructive element will be activated so as to render material stored in the space no longer valuable or unusable. An overlapping drill guard is provided at joins and doors, and electric contacts which function to break the signal circuit when an attempt is made to separate the join are provided inwardly thereof. These electric contacts are conveniently connected in series with the alarm mats, so as to reduce the number of current circuits.

The inventive laminate can be used, for instance, in the construction of containers or cases for the transportation of valuable items, such as for cash transportation, security containers for use in motor vehicles and aircraft, weapon storage systems, inexpensive bank vaults, etc.

The inventive laminate can also be used to provide around different containers, localities and spaces a shell which will make unauthorized access impossible without activating an alarm system or a destructive system.

It will be understood that the inventive laminate may be constructed in various ways. In its simplest form, the laminate will consist solely of one alarm layer and one outer sheet or layer, provided that the alarm layer, or mat, is bonded adhesively to the outer layer in a effective and satisfactory manner. The laminate may include further layers or sheets of different kinds if so desired. The materials used may also vary. By way of non-limiting example, the laminate will suitably have a thickness of about 5 mm. Furthermore, it is often suitable for the laminate to be non-transparent. The alarm mat is suitable baked, moulded or glued firmly in the laminate. The laminate may also be provided with stiffening means.

In those cases when the laminate comprises optical fibres instead of electrically conductive threads, the remaining, peripheral equipment will, of course, be adapted to the use of optical fibres, and that the above description concerning electric current circuits will, instead, apply to light signal circuits.

The invention is therefore not restricted to the aforedescribed and illustrated embodiments thereof, since modifications and changes can be made within the scope of the following claims.

One feature of the invention resides broadly in a laminate structure 10 having integral therewith an alarm mat 2 and intended particularly for the construction of security containers and security rooms, wherein the alarm mat 2 is constructed from one or more insulted, electrically conductive threads, wires or the like 5, 5', or from one of more light conducting, optical fibres, characterized in that the thread or threads 5, 5' is/are disposed to form continuous meshes, loops or eyes of the kind obtained when knitting or crocheting.

Another feature of the invention resides broadly in a laminate structure, characterized in that the meshes, loops or eyes are formed by at least two parallel threads 5, 5' or optical fibres which are so connected mutually at 6 at their free ends as to form an electric circuit or an optical circuit in which current flows in mutually different directions in the parallel threads 5, 5' or fibres.

Yet another feature of the invention resides broadly in a laminate structure, characterized in that the meshes, loops or eyes have small size so as to provide a fine-mesh alarm mat 2.

Still another feature of the invention resides broadly in a laminate structure, characterized in that the laminate 10 has at least one outer sheet or layer 1 which is joined to the alarm mat 2. A further feature of the invention resides broadly in a laminate structure, characterized in that the laminate 10 has a flat, curved or angled shape.

Another feature of the invention resides broadly in the use of a laminate structure, characterized in that the laminate 10 is used to construct a container casing 20 or a room 40 in which objects are to be protected against unauthorized access.

Yet another feature of the invention resides broadly in the use of a laminate structure, characterized in that the laminates 10 are joined with an overlap 21, 41, and in that the alarm mats 2 are connected one to another.

Still another feature of the invention resides broadly in the use of a laminate structure, characterized by using angled wall sections 10*c* to provide overlapping joint zones 41 at the corners of the room 40 or the container.

A further feature of the invention resides broadly in the use of a laminate structure, characterized in that the container 20 includes at least two laminate structures 10*a*, 10*b* which overlap one another in an overlap zone 21, and in that means 24, 25 for detecting an attempt to separate the laminates 10, 10*b* in the overlap region 21 are provided inwardly of said overlap region.

Another feature of the invention resides broadly in the security container, characterized in that the alarm mats 2 and the detecting devices 24, 25 are mutually connected in one or more electric circuits or optical circuits, wherein an unauthorized break in electric circuit or circuits, or in the optical circuit or circuits will activate a destructive element provided within the container 20 and therewith render the items stored in the container unusable.

A further feature of the invention resides broadly in a structure having integral therewith an alarm mat and intended particularly for the construction of security containers and security rooms, wherein the alarm mat is constructed from one or more insulated, electrically conductive threads, wires or the like, or from one or more light conducting, optical fibres, wherein the thread or threads is/are disposed to form continuous meshes, loops or eye of the kind obtained when knitting or crocheting.

Yet another feature of the invention resides broadly in a structure wherein the meshes, loops or eyes are formed by at least two parallel threads or optical fibres which are so connected mutually at their free ends as to form an electric circuit or an optical circuit in which current or light flows in mutually different directions in the parallel threads or fibres.

Still another feature of the invention resides broadly in a structure wherein the meshes, loops or eyes have small size so as to provide a fine-mesh alarm mat.

Another feature of the invention resides broadly in a structure wherein the laminate has at least one outer sheet or layer which is joined to the alarm mat.

A further feature of the invention resides broadly in a structure wherein the laminate has a flat, curved or angled shape.

Another feature of the invention resides broadly in the use of a structure wherein the laminate is used to construct a container casing or a room in which objects are to be protected against unauthorized access.

Yet another feature of the invention resides broadly in the use of the laminate to construct a container casing or a room in which objects are to be protected against unauthorized access.

Still another feature of the invention resides broadly in the use of the laminates wherein the laminates are joined with an overlap and in that the alarm mats are connected one to another.

A further feature of the invention resides broadly in the use of the laminates whereby using angled wall sections to provide overlapping joint zones at the corners of the room or the container.

Another feature of the invention resides broadly in a security container particularly intended for transporting valuable items, said container includes at least two laminate structures, wherein the laminate structures overlap one another in an overlap zone, and in that means for detecting an attempt to separate the laminates in the overlap region are provided inwardly of said overlap region.

Still another feature of the invention resides broadly in a security container wherein the alarm mats and the detecting devices are mutually connected in one or more electric circuits or optical circuits, wherein an unauthorized break in electric circuit or circuits, or in the optical circuit or circuits, will activate a destructive element provided within the container and therewith render the items stored in the container unusable.

A further feature of the invention resides broadly in the use of a structure wherein the laminate is used to construct a container casing or a room in which objects are to be protected against unauthorized access.

Patents relating to polymers include U.S. Pat. No. 4,731,427, entitled, "Method for the Preparation of Rigid Reaction Injection Moldel Thermoset Polyurethane Modified Polyisocyanurate Compositions;" U.S. Pat. No. 4,709,002, entitled "Method for the Preparation of Rigid Non-Cellular Reaction Injection Molded Thermoset Polyisocyanurate Compositions;" and U.S. Pat. No. 4,673,722, entitled, "High Impact Nylon/Polyurea Copolymer."

The corresponding foreign and international patent publication applications, namely, Swedish Patent Application No. SE 9201483-6 filed on May 11, 1992, having inventor Kjell Lindskog, and International Patent Application PCT/SE/9300412, filed on May 10, 1993, and the International Publication Number WO 93/23648, published on Nov. 25, 1993, and the corresponding Swedish Laid Open Patent Application and the corresponding Swedish Patent, as well as their published equivalents, and other equivalents or corresponding applications, if any, in corresponding cases in Sweden and elsewhere, and the references cited in any of the documents cited herein, are hereby incorporated by reference as if set forth in their entirety herein.

Examples of patents relating to electrically conductive plastic, which may be used with at least one embodiment of the invention, can be found in U.S. Pat. No. 5,217,649, entitled "Electrically Conductive Blends of Intrinsically Conductive Polymers and Thermoplastic Polymers Containing Sulfonamide Plasticizer and Acidic Surfactant;" U.S. Pat. No. 5,232,631, entitled "Processible Forms of Electrically Conductive Polyaniline;" U.S. Pat. No. 5,186,862, entitled "Plastic Granulated Material with Non-dispersed Electrically Conductive Fibre Bundles;" and U.S, Pat. No, 5,219,492, entitled "Conductive Plastic Composites."

Patents relating to the use of dye for security reasons, which may be used with at least one embodiment of the invention, can be found in U.S. Pat. No. 5,264,410, entitled "Security Laminates;" and U.S. Pat. No. 5,196,828, entitled "Bendable Currency Security Dye Pack." Examples of laminates, which may be used with at least one embodiment of the invention, can be found in U.S. Pat. No. 5,285,734, entitled "Security Enclosures;" U.S. Pat. No. 5,216,854, entitled "Laminated Panel Modular Building Structure and Assembly Method." Examples of optical fibers, which may be used with at least one embodiment of the invention, can be found in U.S. Pat. No. 5,202,673, entitled "Security Method and Apparatus;" U.S. Pat. No. 5,185,845, entitled "Optical Fiber Closure Having Enchanced Storage Capability;" U.S. Pat. No. 5,189,725, entitled "Optical Fiber Closure;" U.S. Pat. No. 5,182,785, entitled "High-flex Optical Fiber Coil Cable;" U.S. Pat. No. 5,274,726, entitled "Optical Fiber Units and Optical Cables;" and U.S. Pat. No. 5,284,346, entitled "Game Apparatus."

An example of a polyester resin adhesive, which may be used with at least one embodiment of the invention, can be found in U.S. Pat. No. 5,225,482, entitled "Adhesive Resin Composition, Laminate Comprising this Composition as Adhesive Layer, and Process for Preparation Thereof." An example of an insulating varnish which may be used with at least one embodiment of the invention, can be found in U.S. Pat. No. 5,218,170, entitled, "Elongate Body Insulated by Means of an insulating Covering." An example of injection-moulding which may be used with at least one embodiment of the invention can be found in U.S. Pat. No. 5,236,657, entitled "Process for Producing Multi-layer Mouldings."

Examples of security latches and closures, which may be used with at least one embodiment of the invention, can be found in the following patent; U.S. Pat. No. D332,906, entitled, "Security Latch;" U.S. Pat. No. 5,207,022, entitled "Security Closures;" U.S. Pat. No. 5,225,162, entitled "Disposable Tamper Evident Locking Device;" U.S. Pat. No. 5,240,131, entitled "Tamper Evident Container Closure;" and U.S. Pat. No. 5,318,218, entitled "Latch for Container." An example of a switch which may be used with at least one embodiment of the present invention can be found in U.S. Pat. No. 5,184,584, entitled "Remote Starter For Alarm System Equipped Vehicles."

All or substantially all, of the components and methods of the various embodiments may be used with at least one embodiment or all of the embodiments, if any, described herein.

All of the patents, patent applications and publications recited herein, and in the Declaration attached hereto, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings in their entirety, including all dimensions, proportions and/or shapes in at least one embodiment of the invention, are accurate and to scale and are hereby included by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. An electrically protected hand-holdable transportable case with a handle to be held in the hand of the transporter, for the storage of theft attractive articles, said electrically protected case comprising:

an electrical laminate;

electrical protective apparatus;

said electrical protective apparatus comprising at least one of:

electrically activatable alarm apparatus to sound an alarm; and electrically activatable destructive apparatus to render the articles stored in said case unusable;

said electrical protective apparatus and said electrical laminate being connected with electric circuitry to permit said electrical protective apparatus to be activated upon an attempted unauthorized entry into said case; and said electrical laminate comprising:

at least one elongated electrically conductive wire;

said at least one elongated electrically conductive wire forming an electrical mesh mat of substantially continuous meshes, loops or eyes of the kind obtained when knitting or crocheting;

said meshes, loops or eyes being configured and sized to provide resistance to external disturbances comprising at least one of: magnetic fields, static electricity, electromagnetic fields and electrostatic fields, to thus minimize a risk of a false activation of said protective apparatus;

at least one outer sheet;

said electrical mesh mat having at least one surface area disposed immediately adjacent to said at least one outer sheet;

said at least one outer sheet having at least one surface area disposed immediately adjacent to said electrical mesh mat; and said at least one surface area of said at leapt one outer sheet and said at least one surface area of said electrical mesh mat being joined to one another over substantially the entire immediately adjacent surface areas therebetween to form a laminated structure of said at least one outer sheet and said electrical mesh mat;

a body;

a handle;

said handle being connected to said body to permit a hand of a person to lift and carry said case by said handle;

said body having a plurality of extensive outer surfaces; and each of said plurality of extensive outer surfaces being formed substantially entirely by said electrical laminate to protect said case from unauthorized entry into said case.

2. The electrically protected case according to claim 1, wherein said electrical mesh mat comprises said meshes, loops or eyes having a diametral distance across said meshes, loops or eyes of about 1 millimeter.

3. The electrically protected case according to claim 2, wherein said electrical laminate comprises at least one of: a flat, curved, and angled shape.

4. The electrically protected case according to claim 3, wherein:

said at least one elongated electrically conductive wire comprises two elongated electrically conductive wires immediately adjacent and mutually parallel to each another;

said two elongated electrically conductive wires being disposed to form said substantially continuous meshes, loops or eyes, said two elongated electrically conductive wires are connected to each another at their free ends to form an electric circuit; and in said electric circuit, current flows in mutually different directions in said two elongated electrically conductive wires.

5. The electrically protected case according to claim 4, wherein said body comprises:

at least two of said electrical laminate;

said at least two electrical laminates are disposed to overlap one another in at least one overlap zone;

means for joining said electrical laminates in said at least one overlap zone; and means for joining said electrical laminates comprises said electrical mesh mat of each of said electrical laminates being connected one to another in said at least one overlap zone.

6. The electrically protected case according to claim 5, wherein:

each of said two electrical laminates comprises at least one additional sheet being disposed adjacent to said electrical mesh mat, on a side of said electrical mesh mat opposite of said at least one outer sheet;

said body further comprises angled wall sections;

said angled wall sections comprise at least one additional section of said laminate; and said angled wall sections are disposed to form one of said at least one overlap zone at corners of said case.

7. The case according to claim 4, wherein:

said body comprises at least two of said electrical laminates;

said at least two laminates being disposed to overlap one another in an overlap zone;

means for joining said at least two electrical laminates in said overlap zone;

said case comprises apparatus to detect an attempt to separate said laminates in said at least one overlap zone;

said apparatus to detect an attempt to separate said lamninates in said overlap zone being disposed both inward of and directly adjacent to said at least one overlap zone;

said protective apparatus and said apparatus to detect an attempt to separate said at least two electrical laminates in said at least one overlap zone are mutually connected in at least one electric circuit; and said at least one electric circuit is configured to activate said protective apparatus upon an unauthorized break in said at least one electric circuit.

8. An electrically protected container for storage of theft attractive articles, said container comprising:

at least one electrical mesh;

said at least one electrical mesh comprising:

at least one elongated electrically conductive wire;

said at least one elongated conductive wire forming an electrical mesh mat of substantially continuous meshes, loops or eyes of the kind obtained when knitting or crocheting; and said electrical mesh mat being disposed to protect the inside of said container from entry a plurality of extensive outer surfaces; each of said plurality of extensive outer surfaces being protected by said at least one electrical mesh to protect all of said plurality of extensive outer surfaces from penetration through said at least one electrical mesh;

electrical alarm apparatus;

said electrical alarm apparatus and said electrical mesh mat being connected with electric circuitry to permit said electrical alarm apparatus to be activated upon an unauthorized break in said electric circuitry; and said meshes, loops or eyes of said electrical mesh mat being configured and sized to provide in said at least one electrical mesh a substantial resistance to external disturbances, which external disturbances comprise at least one of: magnetic fields, static electricity, electromagnetic fields and electrostatic fields, to thus minimize a risk of a false alarm of said electrical alarm apparatus.

9. The container according to claim 8, wherein said electrical mesh mat comprises said meshes, loops or eyes being of a small size to provide in said at least one electrical mesh said substantial resistance to external disturbances.

10. The container according to claim 9, wherein said at least one electrical mesh further comprises at least one of: a flat, curved, and angled shape.

11. The container according to claim 10, wherein:

said at least one elongated electrically conductive wire comprises two elongated electrically conductive wires immediately adjacent and mutually parallel to one another;

said two elongated electrically conductive wires are disposed to form said substantially continuous meshes, loops or eyes;

said two elongated electrically conductive wires are connected to one another at their free ends to form an electric circuit; and in said electric circuit, current flows in mutually different directions in said two elongated electrically conductive wires.

12. The container according to claim 11, wherein said meshes, loops or eyes have a diametral distance across said meshes, loops or eyes of about 1 millimeter.

13. The container according to claim 12, wherein said container further comprises:

said at least one electrical mesh further comprises at least two electrical meshes;

said at least two electrical meshes are disposed to overlap one another in at least one overlap zone;

means for joining said at least two electrical meshes in said at least one overlap zone;

said means for joining said at least two electrical meshes comprises said electrical mesh mat of each of said at least two electrical meshes being connected one to another in said at least one overlap zone;

angled wall sections;

said angled wall sections comprise at least one additional section of at least one of said at least two electrical meshes and said angled wall sections are disposed to form one of said at least one overlap zone at corners of said container.

14. The container according to claim 12, wherein:

said at least one electrical mesh further comprises at least two electrical meshes;

said at least two electrical meshes are disposed to overlap one another in at least one overlap zone;

said container further comprises means for joining said at least two electrical meshes in said at least one overlap zone;

said container further comprises apparatus to detect an attempt to separate said at least two electrical meshes in said at least one overlap zone;

said apparatus to detect an attempt to separate said at least two electrical meshes in said at least one overlap zone is disposed both inward of and directly adjacent to said at least one overlap zone;

said electrical alarm apparatus and said apparatus to detect an attempt to separate said at least two electrical meshes in said at least one overlap zone are mutually connected in at least one electric circuit;

said at least one electric circuit is configured to activate said electrical alarm apparatus upon an unauthorized break in said at least one electric circuit;

each of said at least two electrical meshes comprises at least one outer sheet;

said electrical mesh mat has at least one surface area disposed immediately adjacent to said at least one outer sheet;

said at least one outer sheet has at least one surface area disposed immediately adjacent to said electrical mesh mat;

said at least one surface area of said at least one outer sheet and said at least one surface area of said electrical mesh mat are joined to one another over substantially the entire immediately adjacent surface areas therebetween to form a structure of said at least one outer sheet and said electrical mesh mat; and each of said at least two electrical meshes comprises at least one additional sheet disposed adjacent to said electrical mesh mat, on a side of said electrical mesh mat opposite to said at least one outer sheet.

15. A method of protecting theft attractive articles in an electrically protected container for storage of theft attractive articles, said container comprising:

a plurality of extensive outer surfaces;

at least one electrical mesh;

each of said plurality of extensive outer surfaces being formed substantially entirely by said at least one electrical mesh to protect all of said plurality of extensive outer surfaces from penetration through said at least one electrical mesh;

said at least one electrical mesh comprising:

at least one elongated electrically conductive wire;

said at least one elongated electrically conductive wire forming an electrical mesh mat of substantially continuous meshes, loops or eyes of the kind obtained when knitting or crocheting;

at least one outer sheet;

said electrical mesh mat having at least one surface area disposed immediately adjacent to said at least one outer sheet;

said at least one outer sheet having at least one surface area disposed immediately adjacent to said electrical mesh mat; and said at least one surface area of said at least one outer sheet and said at least one surface area of said electrical mesh mat being joined to one another over substantially the entire immediately adjacent surface areas therebetween to form a structure of said at least one outer sheet and said electrical mesh mat;

protective apparatus;

said protective apparatus comprising at least one of:

alarm apparatus to sound an alarm; and destructive apparatus to render the articles stored in said container unusable;

said protective apparatus and said electrical mesh mat being connected with electric circuitry to permit said protective apparatus to be activated upon an unauthorized break in said electric circuitry;

said meshes, loops or eyes of said electrical mesh mat being configured and sized to provide resistance to external disturbances comprising at least one of: magnetic fields, static electricity, electromagnetic fields and electrostatic fields;

said electrical mesh mat and said protective apparatus in combination being configured to provide rapid damping of the external disturbances, which rapid damping of the external disturbances is of a sufficient damping speed as to permit the firing of a weapon toward said destructive apparatus and penetrating said electrical mesh mat and still permitting the destructive apparatus to render the articles stored in the container unusable prior to the destruction of the destructive apparatus by the firing of the weapon;

said meshes, loops or eyes of said at least one electrical mesh mat being configured and sized to provide in said electrical mesh a substantial resistance to the external disturbances to thus minimize a risk of a false alarm of said protective apparatus; and said method of protecting theft attractive articles in an electrically protected container comprising the steps of:

providing the electrically protected container;

providing theft attractive articles;

placing the theft attractive articles into the container;

closing the container;

providing in said at least one electrical mesh a substantial resistance to the external disturbances With the meshes, loops or eyes of said electrical mesh mat;

damping the external disturbances with sufficient speed to permit the destructive apparatus to render the articles in the container unusable prior to the destruction of the destructive apparatus by the firing of a weapon;

firing a weapon toward the destructive apparatus of the container;

rendering the articles in the container unusable by the destructive apparatus; and destroying the destructive apparatus by the weapon.

16. The method according to claim 15, wherein:

said meshes, loops or eyes of said electrical mesh mat have a small size to provide said resistance to external disturbances; and said method further comprises the step of providing said resistance to external disturbances with the small size of the meshes, loops or eyes of said electrical mesh mat.

17. The method according to claim 16, wherein said at least one electrical mesh further comprises at least one of: a flat, curved, and angled shape.

18. The method according to claim 17, wherein said meshes, loops or eyes of said electrical mesh mat have a diametral distance across said meshes, loops or eyes of about 1 millimeter.

19. The method according to claim 18, wherein:

said at least one elongated electrically conductive wire comprises two elongated electrically conductive wires immediately adjacent and mutually parallel to one another;

said two elongated electrically conductive wires are disposed to form said substantially continuous meshes, loops or eyes;

said two elongated electrically conductive wires are connected to one another at their free ends to form an electric circuit; and in said electric circuit, current flows in mutually different directions in said two elongated electrically conductive wires.

20. The method according to claim 18, wherein:

said at least one electrical mesh further comprises at least two electrical meshes;

said at least two electrical meshes are disposed to overlap one another in at least one overlap zone;

means for joining said at least two electrical meshes in said at least one overlap zone;

said means for joining said at least two electrical meshes comprises said electrical mesh mat of each of said at least two electrical meshes being connected one to another in said at least one overlap zone;

said container further comprises angled wall sections;

said angled wall sections comprise at least one additional section of said at least two electrical meshes; and said angled wall sections are disposed to form one of said at least one overlap zone at corners of said container body.

21. The method according to claim 19, wherein:

said at least one electrical mesh further comprises at least two said electrical meshes;

said at least two electrical meshes are disposed to overlap one another in at least one overlap zone;

said container further comprises means for joining said at least two electrical meshes in said at least one overlap zone;

said container further comprises apparatus to detect an attempt to separate said at least two electrical meshes in said at least one overlap zone;

said apparatus to detect an attempt to separate said at least two electrical meshes in said at least one overlap zone is disposed both inward of and directly adjacent to said at least one overlap zone;

said protective apparatus and said apparatus to detect an attempt to separate said at least two electrical meshes in said at least one overlap zone are mutually connected in at least one electric circuit;

said at least one electric circuit is configured to activate said destructive apparatus upon an unauthorized break in said at least one electric circuit; and each of said at least two electrical meshes comprises at least one additional sheet being disposed adjacent to said electrical mesh mat, on a side of said electrical mesh mat opposite to said at least one outer sheet.

22. A method of protecting theft attractive articles in an electrically protected container for storage of theft attractive articles, said container comprising:

a plurality of extensive outer surfaces;

at least one electrical mesh;

each of said plurality of extensive outer surfaces being formed substantially entirely by said at least one electrical mesh to protect all of said plurality of extensive outer surfaces from penetration through said at least one electrical mesh;

said at least one electrical mesh comprising:

at least one elongated electrically conductive wire;

said at least one elongated electrically conductive wire forming an electrical mesh mat of substantially continuous meshes, loops or eyes of the kind obtained when knitting or crocheting;

at least one outer sheet;

said electrical mesh mat having at least one surface area disposed immediately adjacent to said at least one outer sheet;

said at least one outer sheet having at least one surface area disposed immediately adjacent to said electrical mesh mat; and said at least one surface area of said at least one outer sheet and said at least one surface area of said electrical mesh mat being joined to one another over substantially the entire immediately adjacent surface areas therebetween to form a structure of said at least one outer sheet and said electrical mesh mat;

protective apparatus;

said protective apparatus comprising at least one of:

alarm apparatus to sound an alarm; and destructive apparatus to render the articles stored in said container unusable;

said protective apparatus and said electrical mesh mat being connected with electric circuitry to permit said protective apparatus to be activated upon an unauthorized break in said electric circuitry;

said meshes, loops or eyes of said electrical mesh mat being configured and sized to provide resistance to external disturbances comprising at least one of: magnetic fields, static electricity, electromagnetic fields and electrostatic fields;

said meshes, loops or eyes of said at least one electrical mesh mat being configured and sized to provide in said electrical mesh a substantial resistance to the external disturbances to thus minimize a risk of a false alarm of said protective apparatus; and said method of protecting theft attractive articles in an electrically protected container comprising the steps of:

providing the electrically protected container;

providing theft attractive articles;

placing the theft attractive articles into the container;

closing the container;

providing in said at least one electrical mesh a substantial resistance to the external disturbances with the meshes, loops or eyes of said electrical mesh mat.

23. An electrically protected container, for the storage of theft attractive articles, said electrically protected container comprising:

an electrical laminate;

electrical protective apparatus;

said electrical protective apparatus comprising at least one of:

electrically activatable alarm apparatus to sound an alarm; and electrically activatable destructive apparatus to render the articles stored in said container unusable;

said electrical protective apparatus and said electrical laminate being connected with electric circuitry to permit said electrical protective apparatus to be activated upon an attempted unauthorized entry into said container; and said electrical laminate comprising:

at least one elongated electrically conductive wire;

said at least one elongated electrically conductive wire forming an electrical mesh mat of substantially continuous meshes, loops or eyes of the kind obtained when knitting or crocheting;

said meshes, loops or eyes being configured and sized to provide resistance to external disturbances comprising at least one of: magnetic fields, static electricity, electromagnetic fields and electrostatic fields, to thus minimize a risk of a false activation of said protective apparatus;

at least one outer sheet;

said electrical mesh mat having at least one surface area disposed immediately adjacent to said at least one outer sheet;

said at least one outer sheet having at least one surface area disposed immediately adjacent to said electrical mesh mat; and said at least one surface area of said at least one outer sheet and said at least one surface area of said electrical mesh mat being joined to one another over substantially the entire immediately adjacent surface areas therebetween to form a laminated structure of said at least one outer sheet and said electrical mesh mat;

a body;

said body having a plurality of extensive outer surfaces; and each of said plurality of extensive outer surfaces being formed substantially entirely by said electrical laminate to protect said container from unauthorized entry into said container.

* * * * *

UNITED STATES PATENT AND TRADEMARK OFFICE

CERTIFICATE OF CORRECTION

PATENT NO. : 6,400,268 B1
DATED : June 4, 2002
INVENTOR(S) : Kjell Lindskog

It is certified that error appears in the above-identified patent and that said Letters Patent is hereby corrected as shown below:

Column 3,
Line 29, after “electric”, delete “motors,” and insert -- motors. --.
Line 33, before “structure,”, delete “not” and insert -- net --.

Column 4,
Line 14, after “sheets”, delete “-are” and insert -- 1-3 are --.

Column 5,
Line 42, after “cable” insert -- 30 --.

Column 10,
Line 28, after the second occurrence of “at”, delete “leapt” and insert -- least --.
Line 61, after “or”, delete “eyes,” and insert -- eyes; --.

Column 11,
Line 56, after “entry” insert -- ; --.

Column 12,
Line 49, after “meshes” insert -- ; --.

Column 14,
Line 27, after “disturbances”, delete “With” and insert -- with --.

Column 15,
Lines 16-17, after “said”, delete “container body.” and insert -- container. --.

Signed and Sealed this

Twenty-eighth Day of January, 2003

JAMES E. ROGAN
*Director of the United States Patent and Trademark Office*